US005346532A

United States Patent [19]

Sinclair et al.

[11] Patent Number: 5,346,532

[45] Date of Patent: Sep. 13, 1994

[54] PROCESS AND APPARATUS FOR RECOVERING METAL VALUES FROM ORE

[76] Inventors: Ian M. Sinclair, 19 Marico Road, Emmarentia, Johannesburg, Transvaal; Henry A. Simonsen, 43 Ann Arbor Place, Glendower, Edenvale, Transvaal, both of South Africa

[21] Appl. No.: 70,719

[22] Filed: Jun. 2, 1993

[30] Foreign Application Priority Data

Jun. 2, 1992 [ZA] South Africa ..... 92/4013

[51] Int. Cl.[5] ..... C22B 3/00; C22B 3/02

[52] U.S. Cl. ..... 75/744; 266/170; 423/31; 423/658.5

[58] Field of Search ..... 266/170; 75/744; 423/31, 658.5

[56] References Cited

U.S. PATENT DOCUMENTS 4,887,799 12/1989 Parrent ..... 423/658.5

FOREIGN PATENT DOCUMENTS 426143 5/1991 European Pat. Off. ..... 423/658.5

*Primary Examiner*—Melvyn J. Andrews

*Attorney, Agent, or Firm*—Stevens, Davis, Miller & Mosher

[57] ABSTRACT

A process and apparatus for recovering metal values from ores is described. Comminuted ores are mixed with a liquid to form a pulp. A plurality of streams of pulp are then projected against one another, thereby causing erosion of ore particles in the pulp. A pair of pulp streams preferably emit through nozzles 68, 70 which are coaxially aligned with each other. The nozzles are located in any impact chamber 66. Gas may be supplied to the impact chamber through a gas inlet 72. The chamber may be kept at an elevated pressure, and the gas may be selected in order to facilitate the reaction of reagents in the pulp with the ore. Pulp from the impact chamber passes into a co-axial vertical tube assembly 78, 80 from where it passes back to a tank 50 for continued treatment.

20 Claims, 3 Drawing Sheets

PROCESS AND APPARATUS FOR RECOVERING METAL VALUES FROM ORE

BACKGROUND OF THE INVENTION

This invention relates to a process and apparatus for recovering metal values from ore.

Metal values such as gold are extracted from ore by comminuting the ore, mixing the ore with water to form a pulp, and treating of the pulp to separate the metal values from the ore. Processes used for this purpose include carbon-in-pulp processes, froth flotation processes, and the mixing of reagents such as cyanide (NaCN) with the pulp to liberate the metal values.

In the case of refractory ores, the ore is commonly roasted prior to cyanidation. Various other techniques, including pressure oxidation, bacterial oxidation and improvements to the basic roasting procedure have been proposed in order to reduce the amount of gold which is lost in the residue of existing processes.

SUMMARY OF THE INVENTION

According to the invention a process for recovering metal values from ore includes the steps of:

comminuting the ore;

mixing the comminuted ore with a liquid to form a pulp; and projecting a plurality of streams of the pulp against one another, thereby causing erosion of ore particles in the pulp.

The process may include introducing a gas, such as oxygen, into a space adjacent to the point of impact of the streams of pulp. The chamber is preferably maintained at an elevated pressure.

Other gases or reagents may be introduced to facilitate liberation of metal values (typically gold) from the pulp.

Typically, the streams of pulp are projected at a velocity which exceeds 60 km per hour, and preferably at a velocity which exceeds 120 km per hour.

In the preferred embodiment of the invention two streams of pulp are projected against each other at the same flow rate and velocity.

The process is preferably carried out with a pair of pulp streams impacting against each other, the two streams being coaxially aligned, each stream emitting from an outlet nozzle which faces directly towards the opposing outlet nozzle, the two nozzles being spaced apart from each other a distance of not more than 50 mm. Each of the streams may have a cross-section diameter of between 5 and 50 mm.

The outlet nozzles preferably have flat end faces.

Further according to the invention apparatus for recovering metal values from ore comprises:

an impact chamber having a plurality of liquid outlets aimed at an impact point;

at least one conduit for supplying pulp under pressure to the liquid outlets so that a plurality of streams of the pulp are projected from the outlets against one another; and means for withdrawing the processed pulp.

The apparatus preferably includes at least one gas inlet in the impact chamber, for introducing gas under pressure into the chamber adjacent to the point of impact of the streams of pulp.

The apparatus preferably includes a contactor conduit below the impact chamber, through which the pulp travels from the impact chamber, the contactor conduit preferably including stream disruptors such as splash bars or plates against which the pulp impacts.

Preferably each liquid outlet is located in a nozzle having a flat end face, the end face having an area which is significantly greater than the area of the outlet, the outlet being located at the geometric centre of the end face.

There are preferably a pair of liquid outlets facing towards each other and coaxially aligned with each other, the outlets being located a distance apart from each other, said distance being not less than half the diameter of the outlets and not greater than ten time the diameter of the outlets.

The nozzles may be manufactured from a plastics material. The nozzles may include a main conduit section, and an end face section, the two sections being separable from each other to enable the end face section to be replaced separately from the main conduit section. The main conduit section may have an internally tapering central passage which converges towards an outlet aperture in the end face section, the outlet aperture having a right circular cylindrical form. The angle of taper of the tapering central passage may be between 1° and 10°.

The apparatus may further comprise a pair of concentric tubular members with the impact chamber leasing into the inner of the two tubular members, the two tubular member being vertically oriented, the outer tubular member having a sealed lower end and the inner tubular member having a lower end with an outlet opening therein which leads into an annulus between the inner and outer tubular members.

Two embodiments of the invention are described in detail in the following passages of the specification which refer to the accompanying drawings. The drawings, however, are merely illustrative of how the invention might be put into effect, so that the specific form and arrangement of the various features shown is not to be understood as limiting on the invention.

DESCRIPTION OF EMBODIMENTS

Figures 1, 2:
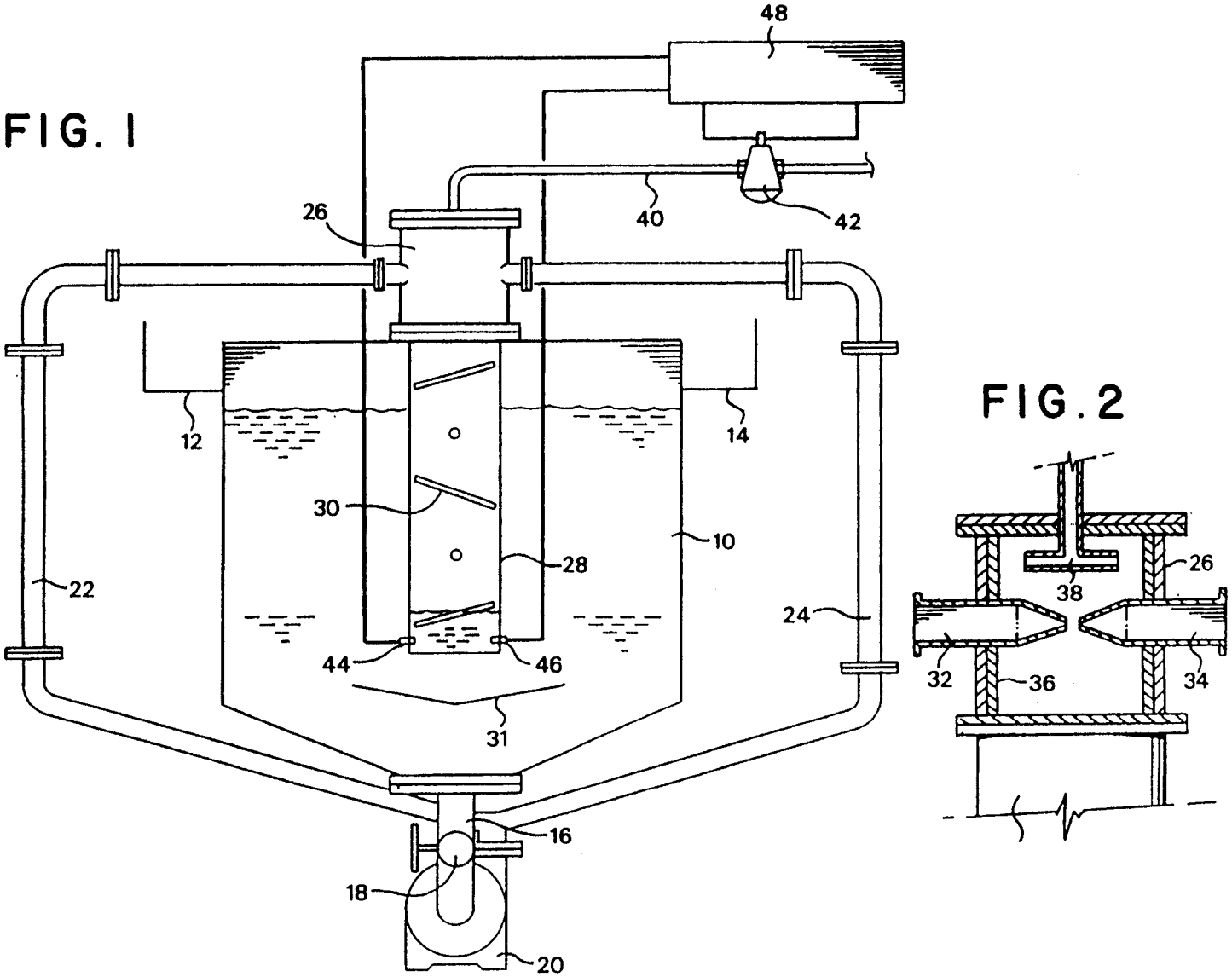
FIG. 1 is a schematic side view of apparatus for recovering metal values from ore according to the invention.
FIG. 2 is a partial sectional view of an impact chamber of the apparatus of FIG. 1.

The apparatus illustrated schematically in FIG. 1 comprises an open topped tank 10 with launders 12 and 14 at its upper edge. The tank 10 thus is a flotation tank. An outlet 16 at the bottom of the tank is controlled by a valve 18. The outlet is connected via the valve to a pump 20 which supplies a pair of rising mains 22 and 24, which feed into opposite sides of a cylindrical contactor chamber 26 at the top of the tank. A contactor tube 28 depends from the impact chamber 26 and extends into the tank 10 to typically 75% of its depth. Splash bars or plates 30 are disposed along the length of the contactor tube, and a dished baffle or deflector 31 is located in the tank 10 below the open bottom end of the tube 28. The baffle 31 assists in circulating the pulp in the tank and prevents "short circuiting" between the lower end of the contactor tube and the tank outlet.

The impact chamber 26 is shown in section in FIG. 2. The chamber is constructed from steel plate and is provided with a pair of removable nozzles 32 and 34 which face each other, with a small clearance between their outlets. The rising mains 22 and 24 are connected to the nozzles 32 and 34 respectively. A wear resistant liner 36 protects the interior of the chamber from wear. Above the nozzles 32 and 34, a T-shaped gas injector 38 is disposed, which is connected to an oxygen line 40. A valve 42 controls the supply of oxygen to the injector 38. A pair of pulp level monitors 4 and 46 are disposed at the bottom of the contactor tube 28 and are connected to a valve controller 48 which controls the operation of the valve 42 according to the level of pulp in the contactor tube 28.

The described apparatus is used for the recovery of metal values, typically gold, from a pulp which is formed by mixing comminuted ore with water. Typically, gold ore is crushed and ground to a fine size, generally so that 80% of the ore particles have a size of less than 20 microns. The ore is mixed with water to form a pulp, which is fed into the tank (generally referred to as a Pachuca or Browns tank). The pulp is agitated in the tank by the injection of air under pressure or by a mechanical agitator (not shown). Reagents including lime (CaO), cyanide (NaCN or $Ca(CN)_2$) and other reagents such as lead nitrate ($Pb(NO_3)_2$) are added to the tank to effect dissolution of the gold. Carbon particles may also be added to the tank for adsorption of the gold onto the carbon particles.

The pump 20 withdraws pulp from the tank via the outlet 16 and the valve 18, and pumps it via the rising mains 22 and 24 to the nozzles 32 and 34 of the impact chamber 26. The nozzles each eject a jet or stream of pulp under pressure, and the streams collide in the space between the nozzles. The impact between the streams of pulp causes severe abrasion of the ore particles in the pulp, which further comminutes the particles and cleans the surfaces of the particles. At the same time, oxygen is introduced into the chamber via the oxygen injector 38, promoting oxidation.

The released pulp stream now descends down the contactor tube 28, impinging on the splash bars or plates 30 as it does so, which tends to break up the pulp stream.

The injection of gas into the impact chamber pressurises the interior of the chamber and the contactor tube 28, with the result that the upper level of the pulp in the contactor tube is depressed towards the bottom of the contactor tube. The combination of the overpressure in the contactor tube and the breaking up of the pulp stream due to the splash bars or plates 30 promotes gas absorption by the liquid phase of the pulp and gas reaction with the solid phase of the pulp. The outputs of the sensors 44 and 46 are operated on by the valve controller 48 to maintain the pulp level generally constant in the contactor tube.

It will be appreciated that additional nozzles, similar to the nozzles 32 and 34, can be added to the impact chamber 26, all aimed at a common impact zone. Similarly, additional gas injectors or injectors for other reagents can be provided. Instead of the nozzles 32 and 34, other discharge devices can be employed. The main requirement of the discharge devices is that they should allow streams or jets of pulp to collide at relatively high velocities, to allow the necessary cleaning and comminution effects to take place. In some cases, a pulsed flow of pulp through the nozzles or discharge devices may be desirable.

Figure 3:
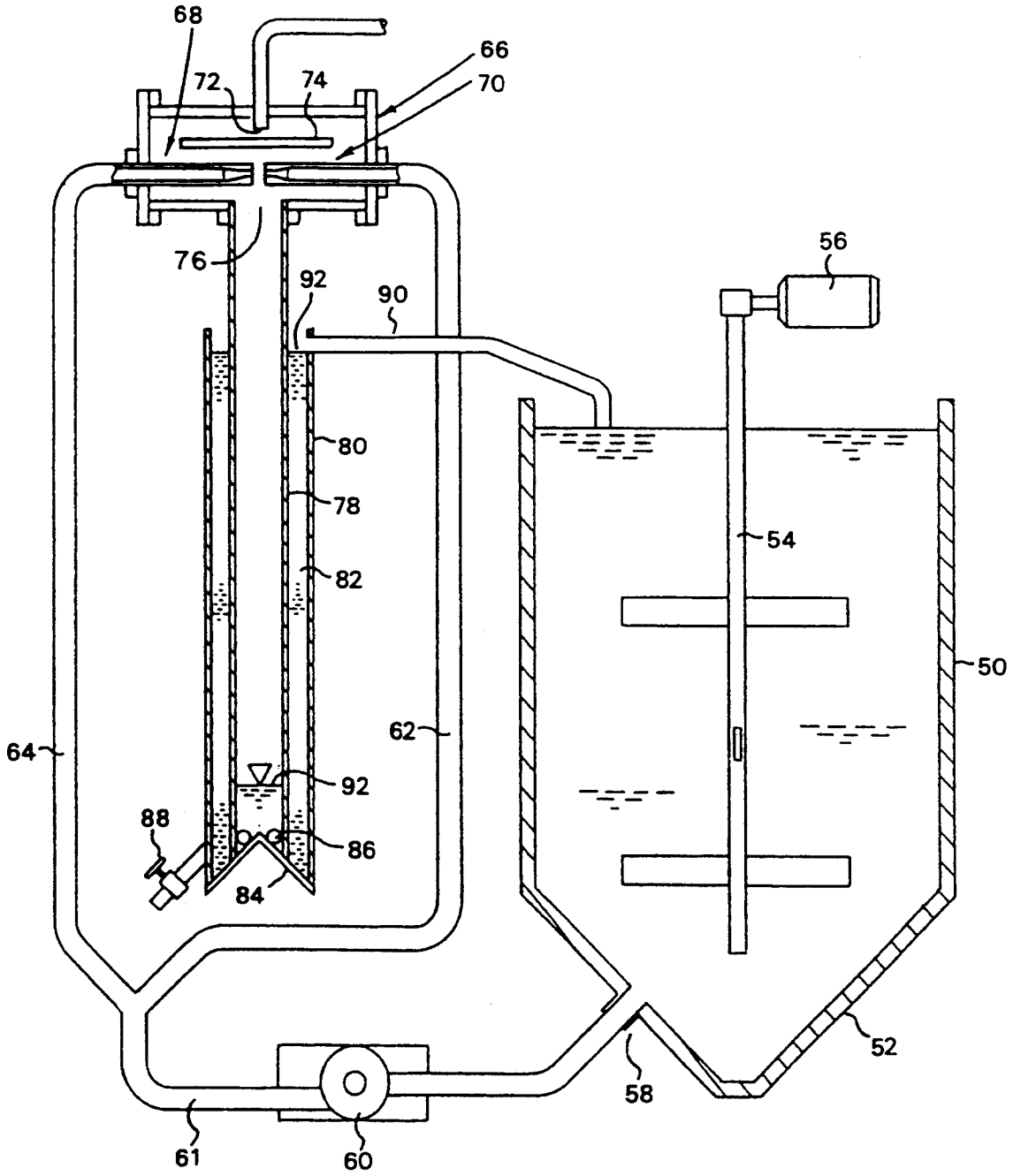
FIG. 3 is a schematic side view of a second embodiment of the apparatus for recovering metal values from an ore according to the invention.
Figure 4:
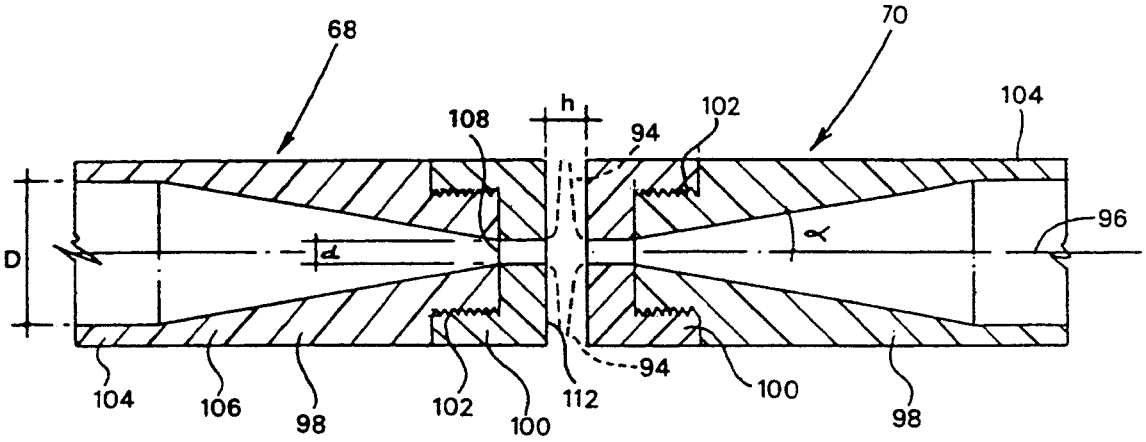
FIG. 4 is a sectional side view of the outlet nozzle arrangement for the embodiment shown in FIG. 3.
Figure 5:
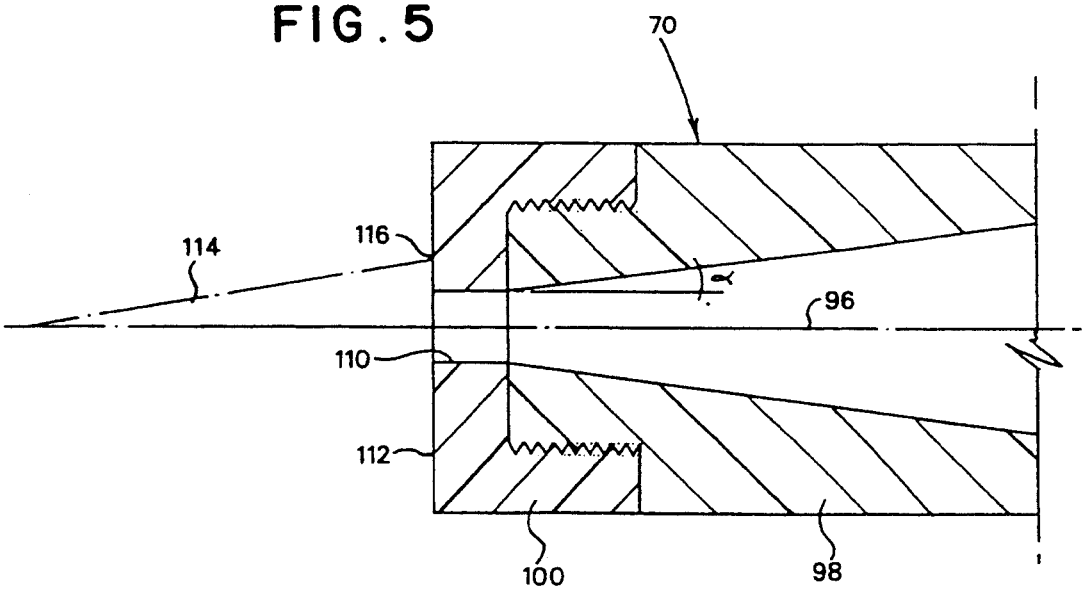
FIG. 5 is an enlarged sectional side view of one of the outlet nozzles shown in FIG. 4.

A second embodiment of the invention is shown in FIGS. 3 to 5 of the drawings. As shown in FIG. 3, an open topped tank 50 (known as a Pachuca or Browns tank) has a conically tapered base 52 and an agitator 54 rotatable by a motor 56. An outlet 58 is provided from the base 52 which supplied pulp to a pump 60. The pump may typically be a 5 to 20 kW pump although larger pumps are envisaged for certain applications or ores. The tank will typically have a volume of between 20 and 100 $m^3$. The tank 50 will typically comprise one of a series of tanks (the other tanks not being shown) which gravity feed, one to the other. Apparatus of the invention may be connected in the manner described below to a plurality of tanks in the series or, alternatively, may be connected to only one of these tanks.

An outlet 61 from the pump leads to a pair of rising mains 62 and 64 which feed into opposite sides of an impact chamber 66. The mains 62 and 64 lead into respective outlet nozzles 68 and 70 which are described in greater detail below with reference to FIG. 4 and 5. The impacting chamber 66 can be of any suitable construction, but it is preferred that it be reasonably easily dismountable to enable the nozzles 68 and 70 to be maintained. As in the previous embodiment, a gas inlet is provided into the chamber 66. A protection plate 74 is mounted within the chamber to prevent the gas inlet 72 being clogged by pulp particles in operation.

An outlet 76 is provided through the lower end of the chamber 66, the outlet 76 leading into a vertical tubular member 78. The tubular member 78 is located within a larger diameter tubular member 80, the two tubular members 78 and 80 thus being concentric and defining an annulus 82 therebetween.

The larger tubular member 80 has an inverted conical base 84 which forms a sealed lower end for the larger tubular member 80. The smaller tubular member 78 seats on this conical base 84. Outlet opening 86 are provided in the lower end of the smaller tubular member so that pulp is able to flow from within the smaller tubular member 78 into the annulus 82. A valve controlled drainage port 88 leads from the annulus to enable the apparatus to be drained. The height of the tubular members will typically be between 3 and 15 m. Higher tubular members will allow gas pressures in the chamber to be increased.

An outlet pipe 90 leads from the upper end 92 of the annulus into the tank 50. Thus, in operation, pulp is drawn from the base of the tank and circulated through the impacting chamber 66 and tubular members 78 and 80 to thereafter feed back into the top of the tank, thereby improving the circulation of pulp within the tank.

When the apparatus is operating properly, the two impacting streams will meet in an impact zone which is midway between the two nozzles. The two streams will then fan radially outwardly in which is known as a Bernoulli "fan", indicated by dotted lines 94 in FIG. 4.

The configuration of the outlet nozzles 68 and 70 are best seen in FIGS. 4 and 5. As shown, the nozzles are basically identical and coaxially aligned on axis 96. The nozzles face each other. Each of the nozzles is formed in two section, a main conduit section 98 and an end face section 100. The two sections connect together by means of co-operating threads 102. The main conduit section comprises a tubular port 104 and a tapered end part 106 which tapers convergently towards an outlet opening 108. The end face section has a central, right circular cylindrical outlet passage 110 therethrough which is the same diameter as the outlet opening 106. The angle of taper $\alpha$ should not be greater than 10° to prevent excessive wear and pressure drop.

In practice, gas is fed under pressure through gas inlet 72 so that the interior of the chamber an the interior of the inner tubular member 78 are both under pressure. The pressure of the gas will be maintained such that the level 92 of pulp in the tubular member 78 is kept near to the outlet openings 86. Typically gas pressures will be from 50 to 100 kPa.

The pump 60 will pump the pulp at a flowrate which is such that the pulp emits through the outlet nozzles at a speed preferably in excess of 100 km/h. The flowrate of pulp through the pump will, of course, depend on the configuration of the nozzles.

The configuration, and relative orientation of the nozzles is important. It will be appreciated that ore containing the pulp is an extremely abrasive fluid which, if it is able to impact on the opposing nozzle will, in a relatively short period of time destroy the opposing nozzle. Accordingly, it is essential that the streams of fluid contact each other in such a manner that virtually no part of one stream is able to spray past the impact zone and impinge on the opposing nozzle.

The nozzles 68 and 70 each have a flat end face 112. This configuration is selected for two reasons. Firstly, it provides a significant body of material surrounding the outlet passage 110 so that, during use, wear in the passage 110 will not break through an edge of the nozzle. Secondly, the flat end face permits a degree of self alignment of the nozzles. As previously mentioned, if the pulp streams do not meet perfectly in the impact zone, pulp can impact on one opposing nozzle. The effect of this misalignment is best seen in FIG. 5. Assume that the pulp stream impacts on the nozzle in the direction of dotted line 114. If the nozzles are resilient or resiliently mounted this will have the effect of moving the nozzle upwardly, i.e., towards the point of impact 116 of the stream. The slight movement of the nozzle 70 will realign the direction of the pulp stream emitting from nozzle 70 thereby causing the two streams to again impact directly against each other and ensure the proper formation of the Bernoulli "fan" 94.

Where wear does occur on the end section 100, this can be easily repaired by replacing the end section. The screw threads 102 permit this easy replacement.

It is preferred that the nozzles 68 and 70 are formed of a plastics material. This has various advantages such as being non-reactive with the pulp, inexpensive, easy to manufacture by injection moulding or like techniques and wear resistant. In addition, plastic can be selected which is slightly resiliently flexible, permitting the realignment of impacting pulp streams previously referred to. A suitable plastic will be polyethylene.

For effective application of the apparatus and proper formation of the Bernoulli "fan" it is preferred that the nozzles are as close together as practicable. It can be shown that the minimum distance (h) which the nozzles can be apart whilst still allowing formation of the Bernoulli "fan" is d/2, that is, h should be greater or equal to half the diameter (d) of the outlet passage 110. In practice it is found that h should be approximately equal to d for best operation. In tests conducted to data, d has been selected at between 8 and 12 mm, D is approximately 80 mm and h is between 6 and 10 mm. The velocity of the pulp stream has been selected at approximately 130 km/h although far lower speeds (60 km/h) and higher speeds (±400 km/h) have also proved to be effective. Higher speeds, however, utilized greater energy which then decreases profitability of the process.

The apparatus can be used in the recovery of various different metal values from ore containing same. In addition, the apparatus can be effectively used in other processes which exposing surfaces of fairly milled material prove advantageous.

To illustrate the efficiency of the invention, the following examples show comparative results in which the process of the invention was utilized on copper containing ores and on gold containing ores. It is, however, to be understood that the invention is not limited to use only on metal containing materials.

EXAMPLE 1

The recovery of gold from a refractory dump deposit.

The dump consisted of old tailings which had been calcined and leached with cyanide in the past. Laboratory tests showed that recovers in excess of 20% were unusual.

Samples of dump material were ground in a ball mill for 290 minutes before being leached with the following reagents:

| | Apparatus of Invention | Pachuca |
|---|---|---|
| NaCN | 2271 grammes per tonne | 2368 grammes per ton |
| $Pb(NO_3)_2$ | 690 grammes per tonne | 709 grammes per ton |
| NaOH | 6799 grammes per tonne | 6817 grammes per ton |
| $Na(OCl)_2$ | 3302 grammes per tonne | 3302 grammes per ton |

Parallel tests were performed on samples of the ore in both the apparatus of the invention (FIG. 3) and a small conventional Pachuca tank with the following results:

| Time (min) | Au (g/t) | Recovery (%) | Time (min) | Au (g/t) | Recovery (%) |
|---|---|---|---|---|---|
| 0 | 3,89 | 0 | 0 | 3,29 | 0 |
| 1105 | 1,74 | 55,3 | 1105 | 2,11 | 35,9 |
| 2350 | 1,30 | 66,6 | 2350 | 2,07 | 37,1 |
| 2895 | 0,89 | 77,1 | 2895 | 1,51 | 54,1 |

It will be noted that after a time of 2895 minutes 77,1% of the gold in the sample had been recovered in the apparatus of the invention whereas after the same time only 54,1% of the gold had been recovered in the conventional Pachuca. This improved recovery will translate in significantly improve revenues over time, even through there are additional energy consumption costs with the process of the invention associated with the operation of the pump.

EXAMPLE 2

Samples of smelter slag from Zaire were subjected to comparative test leaching in the apparatus and a Pachuca tank with the following results:

| Pachuca 1 $H_2SO_4$ (kg/t) 206 | | Pachuca 2 642 | | Apparatus of the invention 1202 | |
|---|---|---|---|---|---|
| Time (min) | Recovery (%) | Time (min) | Recovery (%) | Time (min) | Recovery (%) |
| 0 | 0 | 0 | 0 | 0 | 0 |
| 14 | 6 | 50 | 8 | 9 | 18 |
| 43 | 7 | 100 | 11 | 54 | 22 |
| 76 | 10 | 255 | 12 | 814 | 27 |
| 210 | 12 | 310 | 12 | | |
| 376 | 14 | | | | |

Once again it will be noted that the process of the invention was able to liberate 27% of the copper in the sample whereas the conventional Pachucas were able to liberate only approximately 14% of the copper in the sample.

It should be noted that the gas introduced in the process can assist in the liberation of the metal from the ore. The gas which is introduced will obviously be selected to enhance the chemical reaction taking place.

The process of gold dissolution can be described by the following equation:

$$2Au+4CN+O_2+2H_2O=2Au(CN)_2+2OH+H_2O_2$$

(Burkin A.R., The Chemistry of Hydrometallurgical Processes, E.& F.N. Spon Ltd., London 1966, p51).

Tests conducted independently of the apparatus of the invention have shown that an increased rate of cyanidation can be achieved by the use of oxygen in the gold recovery process, under pressure if necessary, and increased agitation of the pulp. Accordingly, the supply of oxygen under pressure through gas inlet 22 will, it is envisaged, improve the rate of recovery. Other ores may require a different gas.

The described process and apparatus provide an alternative to existing methods of aerating, oxygenating and maintaining a suspension in tanks employed for the dissolution of gold or other metals. The invention has particular application to the beneficiation of refractory gold ores, since it provides increased exposure of the gold particles to reagents. In particular, the invention allows sulphide and other refractory particles to be exposed to an enriched oxygen atmosphere under abrasive conditions. It will be appreciated that use of the apparatus leads to some communition of the solid particles in the pulp but an important feature is the cleaning or exposing of surfaces of the ore leading to an enhanced attack of the ore by the reagents in the pulp.

We claim

1. A process for recovering metal values from ore including the steps of:

comminuting the ore;

mixing the comminuted ore with a liquid to form a pulp; and projecting a plurality of streams of the pulp against one another, thereby causing erosion of ore particles in the pulp.

2. A process according to claim 1 wherein the gas is oxygen.

3. A process according to claim 1 wherein the streams of pulp are projected at a velocity of between 60 and 400 km/h.

4. A process according to claim 3 wherein the streams of pulp are projected at a velocity of between 100 and 200 km/h.

5. A process according to claim 1 wherein there are two streams of pulp, the process including the steps of projecting the two streams at each other coaxially and at the same flowrate and velocity.

6. A process according to claim 5 wherein the streams have a cross-sectional diameter of between 5 and 50 mm.

7. A process according to claim 6 wherein the streams are arranged to emit from nozzles spaced apart by a distance of between d/2 and 10 d where d is equal to the cross-sectional diameter of the streams.

8. A process according to claim 7 wherein the pulp streams are arranged to emit from nozzles having flat end faces.

9. Apparatus for recovering metal values from an ore comprising:

an impact chamber having a plurality of liquid outlets aimed at an impact point;

at least one conduit for supplying pulp under pressure to the liquid outlets so that a plurality of streams of the pulp are projected from the outlets against one another; and means for withdrawing the processed pulp.

10. Apparatus according to claim 9 which includes a contactor conduit below the impact chamber through which, in use, pulp travels from the impact chamber.

11. Apparatus according to claim 10 which includes splash bars in the contactor conduit.

12. Apparatus according to claim 9 wherein each liquid outlet is located in a nozzle having a flat end face, the end face having an area which is significantly greater than the area of the outlet, the outlet being located at the geometric center of the end face.

13. Apparatus according to claim 9 wherein there are a pair of liquid outlets facing towards each other and co-axially aligned with each other, the outlets being located a distance apart from each other, said distance being not less than half the diameter of the outlets and not greater than ten times the diameter of the outlets.

14. Apparatus according to claim 9 wherein the outlets are located in nozzles formed of a resilient plastics material.

15. Apparatus according to claim 14 wherein each nozzle comprises a main conduit section and an end face section, the two sections being separable from each other to enable the end face section to be replaceable separately from said main conduit section.

16. Apparatus according to claim 15 wherein the main conduit section has an internally tapering central passage which converges towards an outlet aperture in the end face section, the outlet aperture having a right circular cylindrical form.

17. Apparatus according to claim 16 wherein the angle of taper is not greater than 10°.

18. Apparatus according to claim 9 wherein the impact chamber is located above a pair of concentric tubular members, an outlet from the impact chamber leading into the inner one of the two tubular members, the two tubular members being vertically oriented, the outer tubular member having a sealed lower end and the inner tubular member having a lower end with an outlet opening therein which leads into an annulus between the inner and outer tubular members.

19. Apparatus according to claim 9 in assembly with a relatively large volume tank, conduits from and to the tank conveying pulp to and from the apparatus respectively for treatment in the apparatus.

20. Apparatus according to any one of claims 9 to 19 which includes means for maintaining the pressure in the impact chamber at above atmospheric pressure.

* * * * *

UNITED STATES PATENT AND TRADEMARK OFFICE

CERTIFICATE OF CORRECTION

PATENT NO. : 5,346,532

DATED : September 13, 1994

INVENTOR(S) : Ian MacDonald SINCLAIR et al

It is certified that error appears in the above-indentified patent and that said Letters Patent is hereby corrected as shown below:

Column 5, line 2, delete "port" and insert --part--.
Column 6, line 12, delete "fairly" and insert --finely--.

Column 7,

Claim 2, line 1, delete "A" and insert --The--.

Claim 3, line 1, delete "A" and insert --The--.

Claim 4, line 1, delete "A" and insert --The--.

Claim 5, line 1, delete "A" and insert --The--.

Claim 6, line 1, delete "A" and insert --The--.

UNITED STATES PATENT AND TRADEMARK OFFICE

CERTIFICATE OF CORRECTION

PATENT NO. : 5,346,532

DATED : September 13, 1994

INVENTOR(S) : Ian MacDonald SINCLAIR et al

It is certified that error appears in the above-indentified patent and that said Letters Patent is hereby corrected as shown below:

Column 8,

Claim 7, line 1, delete "A" and insert --The--.

Claim 8, line 1, delete "A" and insert --The--;

Claim 10, line 1, delete "Apparatus" and insert --The apparatus--.

Claim 11, line 1, delete "Apparatus" and insert --The apparatus--.

Claim 12, line 1, delete "Apparatus" and insert --The apparatus--.

Claim 13, line 1, delete "Apparatus" and insert --The apparatus--.

Claim 14, line 1, delete "Apparatus" and insert --The apparatus--.

Claim 15, line 1, delete "Apparatus" and insert --The apparatus--.

Claim 16, line 1, delete "Apparatus" and insert --The apparatus--.

Claim 17, line 1, delete "Apparatus" and insert --The apparatus--.

Claim 18, line 1, delete "Apparatus" and insert --The apparatus--.

UNITED STATES PATENT AND TRADEMARK OFFICE

CERTIFICATE OF CORRECTION

PATENT NO. : 5,346,532

DATED : September 13, 1994

INVENTOR(S) : Ian MacDonald SINCLAIR et al

It is certified that error appears in the above-indentified patent and that said Letters Patent is hereby corrected as shown below:

Column 8,

Claim 19, line 1, delete "Apparatus" and insert --The apparatus--.

Claim 20, line 1, delete "Apparatus" and insert --The apparatus--; and delete "to 19".

Signed and Sealed this

Thirtieth Day of April, 1996

*Attest:*

*Attesting Officer*

BRUCE LEHMAN

*Commissioner of Patents and Trademarks*